US005226784A

United States Patent [19]

Mueller et al.

[11] Patent Number: 5,226,784

[45] Date of Patent: Jul. 13, 1993

[54] BLADE DAMPER

[75] Inventors: Peter W. Mueller, Morrow; Joseph T. Stevenson, Amelia; Josef Panovsky; Christopher C. Glynn, both of Hamilton; Sang Y. Park, W. Chester; Daniel E. Wines, Cincinnati, all of Ohio

[73] Assignee: General Electric Company, Cincinnati, Ohio

[21] Appl. No.: 951,929

[22] Filed: Sep. 25, 1992

Related U.S. Application Data

[63] Continuation of Ser. No. 653,218, Feb. 11, 1991, abandoned.

[51] Int. Cl.[5] ..... F01D 5/10

[52] U.S. Cl. ..... 416/248; 416/500

[58] Field of Search ..... 416/248, 500

[56] References Cited

U.S. PATENT DOCUMENTS

| | | | |
|---|---|---|---|
| 1,554,614 | 9/1925 | Allen . | |
| 2,310,412 | 2/1943 | Flanders | 416/190 |
| 2,942,843 | 6/1960 | Sampson | 253/77 |
| 3,292,900 | 12/1966 | Petterson | 416/248 |
| 3,887,298 | 6/1975 | Hess et al. | 416/220 |
| 3,918,842 | 11/1975 | Longley et al. | 416/219 |
| 4,101,245 | 7/1978 | Hess et al. | 416/190 |
| 4,120,607 | 10/1978 | Coplin | 416/248 |
| 4,480,957 | 11/1984 | Patel et al. | 416/500 |
| 4,482,297 | 11/1984 | Mosimann et al. | 416/218 |
| 4,568,247 | 2/1986 | Jones et al. | 416/190 |
| 4,684,326 | 8/1987 | Wassell et al. | 416/215 |
| 4,743,166 | 5/1988 | Elston, III et al. | 416/500 |
| 4,767,247 | 8/1988 | Partington et al. | 416/500 |
| 4,872,812 | 10/1989 | Hendley et al. | 416/190 |
| 5,052,890 | 10/1991 | Roberts | 416/500 |

FOREIGN PATENT DOCUMENTS

| | | | |
|---|---|---|---|
| 42539 | 1/1923 | Austria | 416/248 |
| 418618 | 1/1972 | U.S.S.R. | 416/500 |
| 671960 | 5/1952 | United Kingdom | 416/500 |

*Primary Examiner*—John T. Kwon

*Attorney, Agent, or Firm*—Jerome C. Squillaro; David L. Narciso

[57] ABSTRACT

The present invention provides a phase independent damper and damper assembly capable of damping rotor blade vibrations in the axial, circumferential, and radial directions. One embodiment, particularly useful in an aircraft gas turbine engine compressor rotor, provides a damper and damper assembly including a generally axially extending blade damper operable to fictionally engage a generally axially extending circumferentially facing surface of a disk and axially extending angled surface under the platform of the blade. The invention provides an additional advantage of allowing simple and easy modification of existing engines to incorporate the damper of the present invention.

8 Claims, 4 Drawing Sheets

BLADE DAMPER

BACKGROUND OF THE INVENTION

The Government has rights in this invention pursuant to Contract No. F33657-88C-2133 awarded by the Department of the Air Force.

This application is a continuation of application Ser. No. 07/653,318, filed Feb. 11, 1991, now abandoned.

FIELD OF THE INVENTION

This invention relates to axial flow machines and specifically to the damping of vibratory energy in the blades of such machines. The invention was developed for use with gas turbine engine compressor rotor blades but has wider applicability to other axial flow machines with rotor blades.

DESCRIPTION OF RELATED ART

A typical compressor rotor assembly of a gas turbine engine has a plurality of rotor blades extending radially outward across a fluid path which in the case of gas turbine engines is usually referred to as the working medium i.e. air for jet engines. Blades generally comprise an airfoil section mounted radially outward of a blade root section with a platform therebetween which forms a portion of the boundary between the rotor and the working medium. The blade is normally mounted in the rim of a rotor disk by its root interlockingly engaging a slot cut in the rim. Compressor blade roots are conventionally curvilinear in form and referred to as dovetail roots and the matching conforming slots as dovetail slots. Formed between the slots are posts in the rim of the disk which may have a radially outer surface forming another portion of the flowpath boundary.

High rotational rotor speeds induce vibratory stresses in the rotors and blades which cause high cycle fatigue and potential failure of the blade and post. High cycle fatigue life of rotor blades have been extended by incorporating damping means to reduce the vibratory stresses occasioned by the high rotational speeds.

It is well known to use blade dampers for compressor and turbine rotors in gas turbine engines and to place the dampers in the space between blades at the blade root to disk attachment sections. Most damper assemblies, including the blade platforms, are designed to provide blade to blade damping generally between circumferentially adjacent blades, most often between adjacent blade platforms or blade tip shrouds. Some examples of such blade to blade dampers are shown in U.S. Pat. No. 4,872,812 entitled "Turbine Blade Platform Sealing and Vibration Damping Device" granted to D. G. Hendley et al. on Oct. 10, 1989; U.S. Pat. No. 4,101,245 entitled "Interblade Damper and Seal for Turbomachinery Rotor" granted to J. R. Hess and H. F. Asplund on Jul. 18, 1978; U.S. Pat. No. 2,942,843 entitled "Blade Vibration Damping Structure" granted to R. C. Sampson on Jun. 15, 1956; and U.S. Pat. No. 1,554,614 entitled "Turbine Blading" granted to R. C. Allen on Sep. 13, 1922.

The rotor blade damper assemblies exemplified in the above noted patents disclose means for achieving damping but fail to dampen all the vibratory modes rotor blades may be subject to. Blade dampers rely on centrifugal force acting on the damper to urge the damper into contact with adjacent surfaces with minimally sufficient force to cause contact yet allow for slippage and friction between the adjacent elements or surfaces. Conventional blade dampers rely on friction between the blade and the damper and therefore require a slip load force between them. Referring to the prior art illustrated in FIG. 1A, adjacent blades 10*a* and 12*a* vibrating 180° out of phase in the circumferential direction, as indicated by their respective motion arrows, produce the maximum relative velocity δ between adjacent blade platforms 20*a* and 22*a* and damper 15*a* and the blade. Conversely, the more blades vibrate in phase, as illustrated in FIG. 1B there is less relative motion δ between adjacent blades 10*a* and 12*a* and damper 15*a* and less friction and damping of the blade's vibrations.

Illustrated in FIGS. 1A and 1B are relatively out of and in phase motion respectively as exemplified by a typical under platform damper 15*a* for a circumferential mode of vibration. The same problem exists where axial modes of vibration occur, as illustrated in FIGS. 2A and 2B which depict in and out of phase motion respectively, wherein blade to blade damper 15*a* is ineffective in damping in phase vibration because no relative motion exists between the damper and the blade, as illustrated by the respective arrows in FIG. 2B. Specifically, under-platform blade to blade dampers are vibration mode specific and for that reason have limited application.

In contrast, blade to ground dampers having axially, radially, and circumferentially extending frictional surfaces, as in the present invention, are effective for any vibratory mode of the blade (independent of any specific blade to blade relationship) because the damper captures the full-three dimensional motion of the blade and transfers it to the relatively stationary post thereby effecting the desired vibratory stress reduction in both blade and post.

SUMMARY OF THE INVENTION

Therefore in order to provide a phase independent damping means for damping rotor blade vibrations the present invention provides a rotor blade damper, of the blade to ground type, and damper apparatus operable to effect a frictional damping force between the blade and the disk along axially, radially, and circumferentially extending planar surfaces. The present invention provides a triangular damper having generally axially and circumferentially extending frictional surfaces disposed in a chamber between the disk and the blade formed by an axially extending recess in a blade slot post and an adjoining blade platform. In the preferred embodiment of the present invention the triangular damper is a right angle triangular damper.

The blade includes a generally axially extending blade surface, preferably under a blade platform, which is generally angled with respect to a rotor radius and operable to engage the hypotenuse surface of the triangular damper under centrifugal loading during rotor operation. Additional features and embodiments are contemplated that require only a portion of the damper to be triangular.

ADVANTAGES

Among the advantages provided by the rotor blade damping assembly of the present invention is phase independent multi-mode damping which is the ability of the damper to dampen in phase as well as out of phase blade vibrations in the circumferential, axial and radial directions. Another advantage provided by the present invention is to maximize damping of rotor blade vibrations that are partially in phase and partially out of phase by being able to dampen the in phase component of the vibration. Another advantage of the present invention is that it provides a relatively simple and inexpensive means to modify an existing engine to either add a new rotor blade damper or modify an existing damper by changing the weight of the damper and therefore adjusting the pressure on the frictional damping surfaces caused by the centrifugal force produced by the rotational motion of the rotor.

A machining method and apparatus for producing the rotor portion of the damper assembly is disclosed in a related U.S. patent application, Ser. No. 07/613,340, filed Nov. 11, 1990 entitled "FIXTURE AND METHOD FOR MACHINING ROTORS" by Peter. W. Mueller et al, and assigned to General Electric, the same assignee as in this application.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 3:
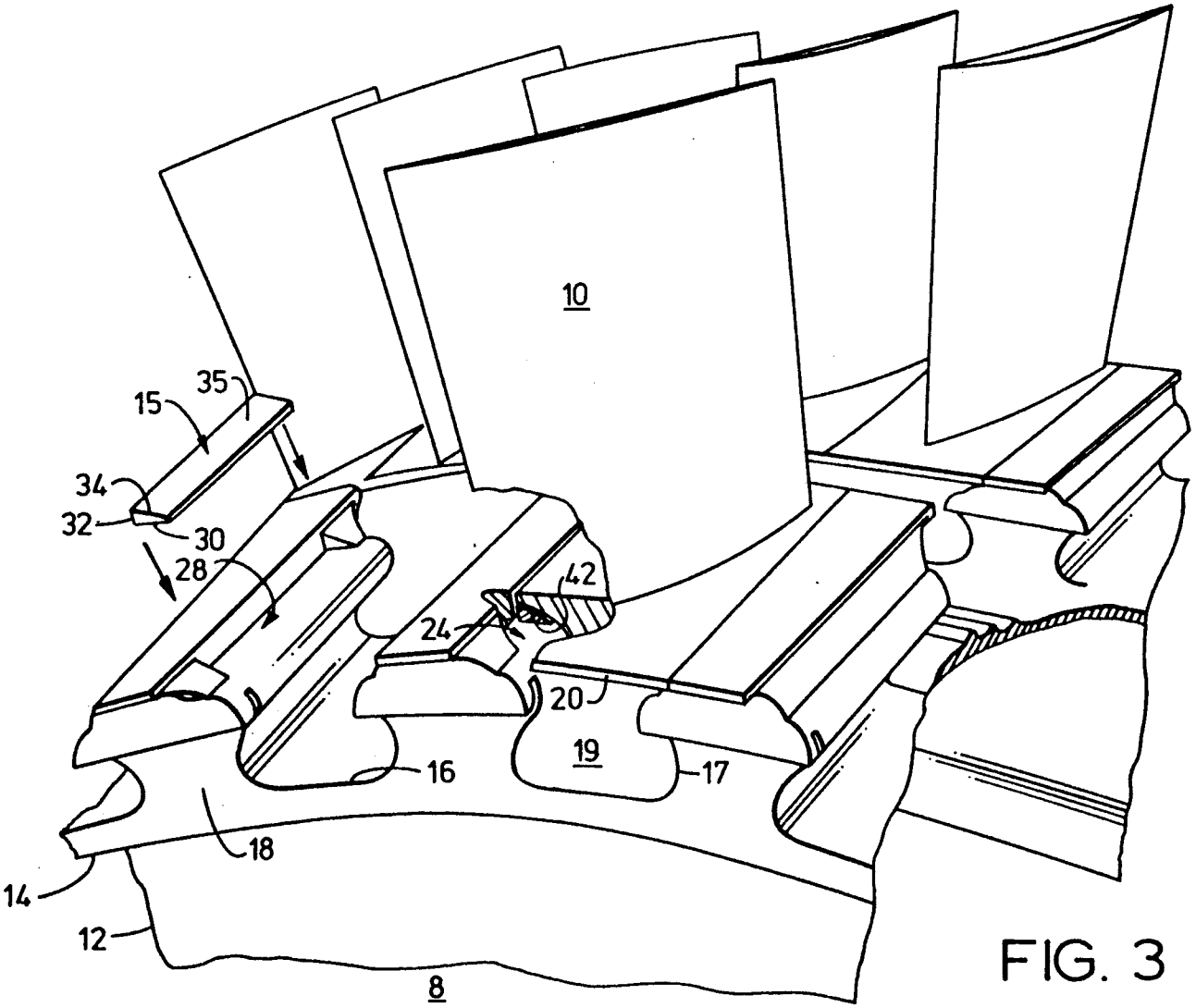
FIG. 3 is a perspective view of a portion of an aircraft gas turbine engine compressor rotor having a blade damper and damper assembly in accordance with the preferred embodiment of the present invention.

Referring to FIG. 3, a portion of a gas turbine engine rotor 8, typical of a section of the high pressure compressor is shown having a disk 12 including a circumscribing rim 14 with a plurality of circumferentially disposed generally axially extending blade slots 16, in the form of dovetail slots, cut therethrough forming dovetail posts 18 therebetween. Note that blade slots 16 are often not cut exactly parallel to the engine's axis or centerline but may be somewhat angled in the circumferential direction for dynamic and structural reasons. Such a direction is considered generally axially extending for the purpose of this patent application. Dovetail slot 16 is operable to receive compressor blade 17 having an airfoil 10 radially outward of a blade root 19, which conforms to and are designed to be received by dovetail slots 16, and a platform 20 therebetween. A damper chamber 24, formed by a recess 28 in post 18 beneath platform 20, retains a generally axially extending damper 15.

Figure 1A:
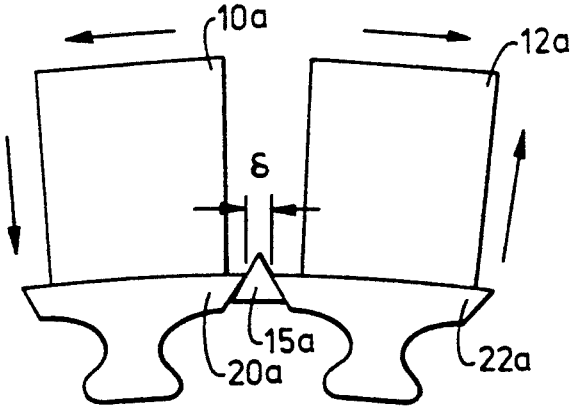
FIG. 1A PRIOR ART
FIGS. 1A and 1B are front views of typical prior art adjacent blades and an under-platform damper therebetween illustrating circumferential out of phase and in phase vibration modes respectively.
Figure 1B:
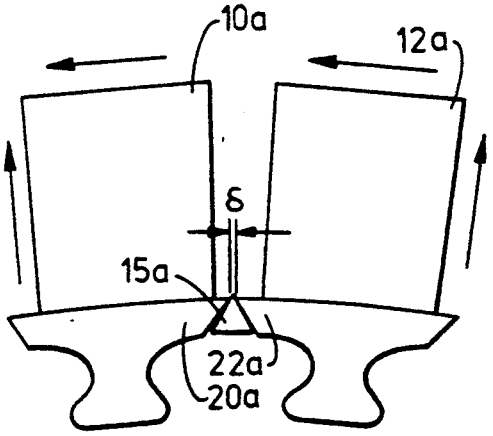
FIG. 1B PRIOR ART
Figure 2B:
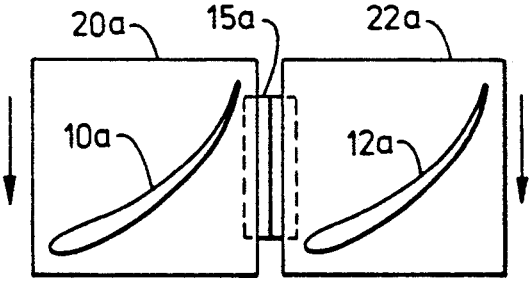
FIG. 2B PRIOR ART
FIGS. 2A and 2B are top views of typical prior art adjacent blades and an under-platform damper therebetween illustrating axial out of phase and in phase vibrational modes respectively.
Figure 2A:
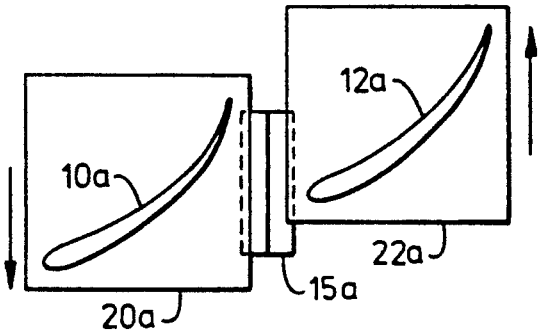
FIG. 2A PRIOR ART
Figure 4:
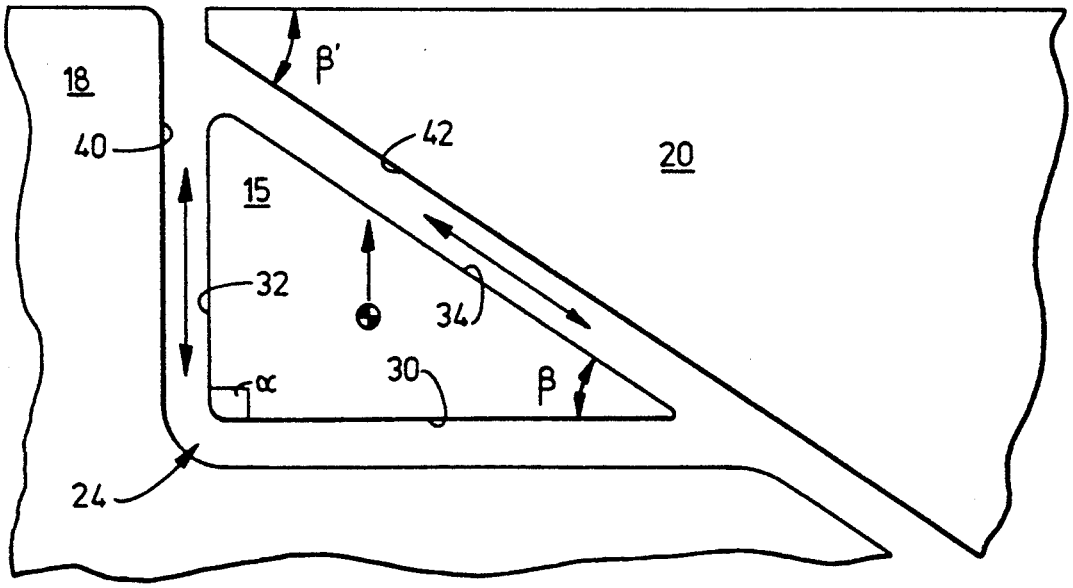
FIG. 4 is a partial cross sectional view taken in the axial direction of the damper in FIG. 3 disposed between a disk and its blade in accordance with the preferred embodiment of the present invention.
Figure 3A:
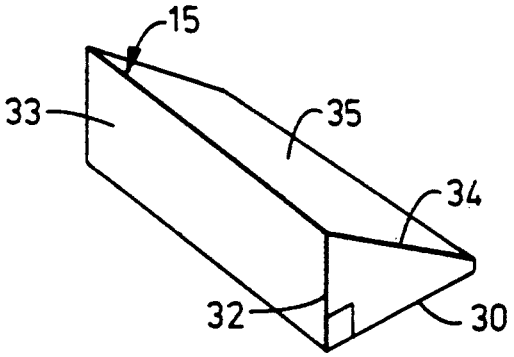
FIG. 3A is a perspective view of the blade damper in FIG. 3 from a different angle.

Referring briefly to FIG. 4, the cross section of damper 15 in accordance with the preferred embodiment is generally triangular in shape having a right angle $\alpha$ between its cirumferentially extending leg 30 and radially extending leg 32. An included angle $\beta$ between cirumferentially extending leg 30 and a hypotenuse 34 is generally equal to a platform slant angle $\beta'$. As shown in FIG. 3A radially extending leg 32 defines a circumferentially facing planar frictional surface 33 of damper 15, operable to dampen by frictional motion in the radial and axial direction. Hypotenuse 34 defines a radially outward and circumferentially facing planar frictional surface 35 which provides the damper assembly with blade to ground damping by relative motion in the circumferential, radial, and axial directions.

The right angle cross-section of damper 15 provides good contact along the damper's frictional surfaces 33 and 34 defined by radially extending leg 32 and hypotenuse 34 respectively with a circumferentially facing surface 40 of recess 28 and a radially inward and circumferentially facing surface 42 under platform 20 of blade 10. Damper 15 is loosely retained in the chamber 24 so that it can properly seat against the surfaces of the disk and blade that it contacts during engine operation under its own centrifugal force due to its mass.

Figure 4A:
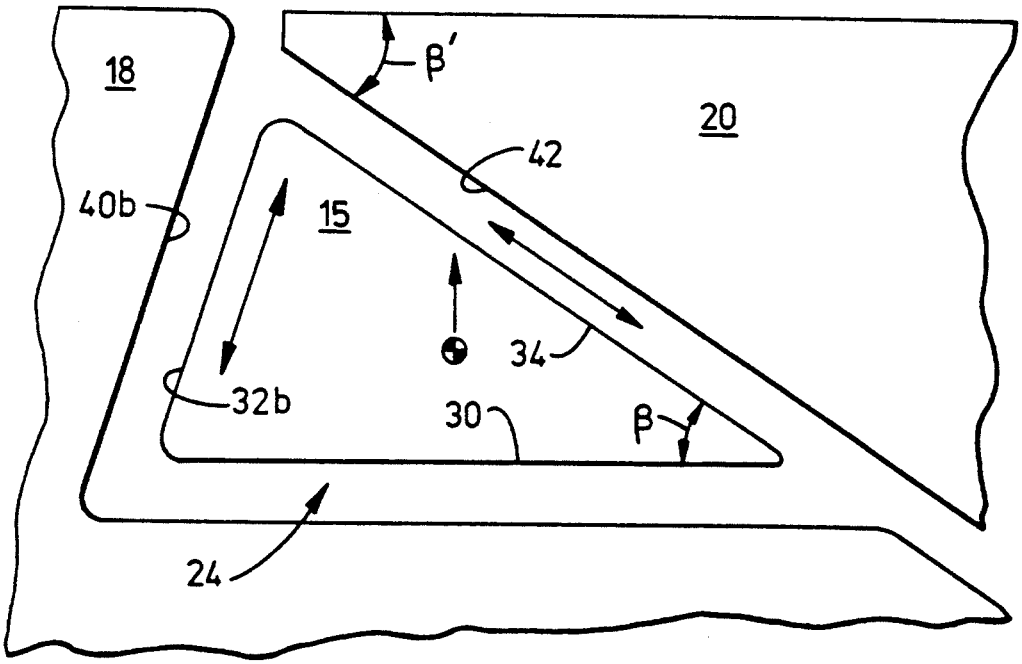
FIG. 4A is a partial cross sectional view taken in the axial direction of an alternative embodiment of the blade damper and damper assembly according to the present invention.

The present invention contemplates a more general triangular cross section damper 15*b* illustrated in FIG. 4A which provides a circumferentially facing surface 40*b* of recess 28 which is indented or inclined with respect to a radius drawn from the axis of rotation so as to face radially inward as well as in the circumferential direction. This embodiment permits greater flexibility to adjust the damper's effectiveness by adding more surface area along the disk for the centrifugally loaded damper to engage and rub against due to relative circumferential and axial motion between the blade and disk.

Figure 5:
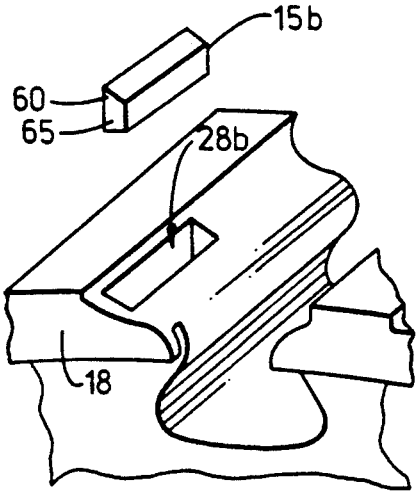
FIGS. 5–8 are alternate embodiments of the damper of the present invention.

An alternative embodiment of the damper of the present invention is shown in FIG. 5 wherein a damper 15*b* includes a radially outer right triangular portion 60 and a radially inner rectangular portion 65 provides a supplemental means for adjusting the mass of the damper without changing its frictional surface area which allows adjustment of the pressure that the damper can exert along its frictional surfaces. The slippage between frictional surfaces is gently effected by this pressure and therefore control of the pressure helps maximize the damping effect.

Figure 6:
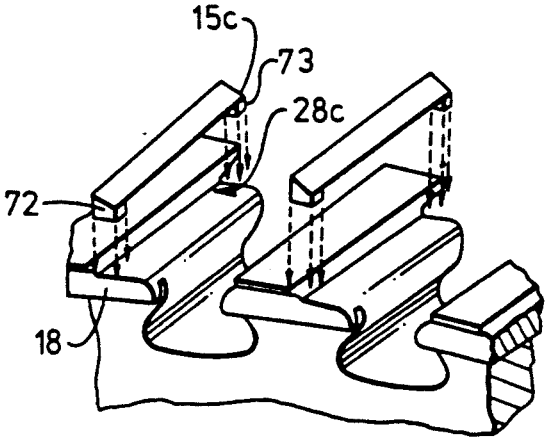
Figure 7:
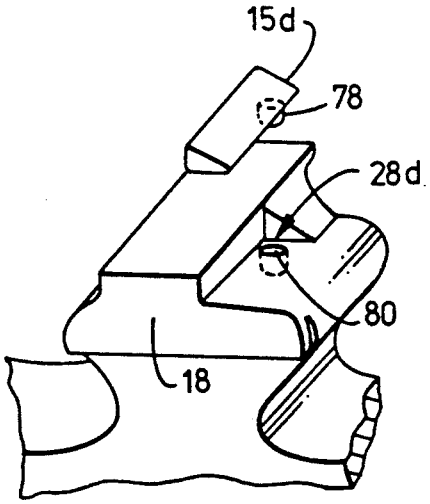

The embodiment shown in FIG. 6 illustrates another damper assembly in accordance with the present invention wherein damper 15*c* extends across the entire disk post 18 as does recess 28*c* and includes radially inward depending forward and aft axial lugs 72 and 73 respectively which are operable for axially retaining the damper in place during blade to disk assembly. Another embodiment, illustrated in FIG. 7, provides a damper 15*d* with a means for axially retaining the damper during blade to disk assembly by providing it which a single radially inward depending lug 78 operable to engage a depression 80 in the radially outward facing surface of recess 28*d*.

Figure 8:
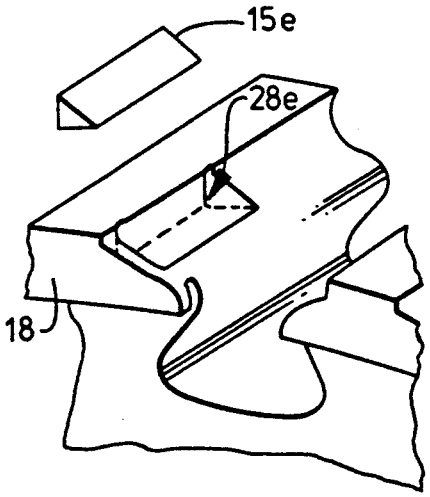

The assembly shown in FIG. 8 illustrates that a recess 28*e* and its respective damper 15*e* may be of varying lengths and may be adjusted when the damper is being sized during the preparation of the recess and damper. This advantage lends itself to adding the damper after assembly of the engine and permits easy modification as described in the Mueller reference above.

While the preferred embodiment of our invention has been described fully in order to explain its principles, it is understood that various modifications or alterations may be made to the preferred embodiment without departing from the scope of the invention as set forth in the appended claims.

We claim:

1. A gas turbine engine rotor blade damper for loosely mounting in a recess of a disk having an axis of rotation, said recess forming a chamber between the disk and blade platform of a blade extending radially outward from the disk, said damper comprising:

a generally axially extending body including at least one radially extending portion having a right angle triangular cross-section wherein at least one leg of said triangular cross-section defines a friction damping surface;

whereby during engine operation centrifugal force seats said damper against said disk and said blade platform.

2. A gas turbine engine rotor blade damper as claimed in claim 1, wherein said body includes a second radially extending portion that depends from said first portion and provides a means for adjusting the mass of the damper.

3. A gas turbine engine rotor blade to ground damper assembly comprising:

a blade having a blade root disposed in a blade slot, said slot formed in a disk between adjacent posts, a generally axially extending chamber formed by a recess in one of said posts between said disk and said blade, said chamber operable to loosely contain a generally axially extending damper, said damper having generally axially extending surfaces conforming to generally axially extending surfaces on said blade and disk, and said damper operable to engage said disk and blade under the centrifugal force due to its mass.

4. A gas turbine engine rotor blade damper assembly comprising:

a generally axially extending chamber between a disk and a blade formed by a generally axially extending recess in a inter-slot post on the disk and a generally axially extending radially angled and radially inward facing of a rotor blade platform, said chamber operable to loosely contain a generally axially extending damper including at least one radially extending portion having a right angle triangular cross-section;

whereby during engine operation the mass of said damper centrifugally forces said damper into engagement with the disk and the blade platform.

5. A gas turbine engine rotor blade to ground damper assembly comprising:

a blade having a blade root disposed in a blade slot, said slot formed in a root between adjacent posts;

an axially extending blade vibration dampening means to dampen rotor blade vibrations independent of the blade vibration's phase wherein said blade vibration dampening means includes a damper having planar frictional surfaces, said damper loosely disposed in a chamber formed by a recess in one of said posts between said blade and said rotor;

whereby during engine operation said damper is operable due to centrifugal force.

6. A gas turbine engine rotor blade to ground damper assembly as claimed in claim 5 wherein said blade vibration dampening means comprises a generally axially extending and circumferentially facing planar rotor surface on said rotor, a generally axially extending and generally circumferentially and radially inward facing planar blade surface of said blade, wherein said rotor surface generally faces said blade surface forming at least a portion of said chamber therebetween.

7. A gas turbine engine rotor blade to ground damper assembly as claimed in claim 6 wherein said damper has at least one radially extending portion having a triangular cross-section including a radially outward facing and generally circumferentially opposite facing planar damper surface facing and and conforming to and said planar blade surface.

8. A gas turbine engine rotor blade to ground damper assembly as claimed in claim 7 wherein said blade surface is disposed on the underside of a platform of said blade.

* * * * *